US005123396A

United States Patent [19]

Shepley et al.

[11] Patent Number: 5,123,396

[45] Date of Patent: Jun. 23, 1992

[54] ACCESSORY MOUNT

[75] Inventors: Pete Shepley; Richard Johnston; Allan F. Smith, all of Tucson, Ariz.

[73] Assignee: Precision Shooting Equipment Company, Tucson, Ariz.

[21] Appl. No.: 613,114

[22] Filed: Nov. 13, 1990

Related U.S. Application Data

[60] Division of Ser. No. 920,034, Oct. 17, 1986, Pat. No. 4,697,350, and a continuation of Ser. No. 429,842, Oct. 31, 1989, abandoned, which is a continuation-in-part of Ser. No. 197,294, May 23, 1988, Pat. No. 5,005,554, which is a continuation of Ser. No. 920,080, Oct. 17, 1986, abandoned, which is a continuation-in-part of Ser. No. 920,034.

[51] Int. Cl.[5] ..... F41B 5/06

[52] U.S. Cl. ..... 124/25.5; 124/25.7; 124/88

[58] Field of Search ..... 124/88, 25.7, 25.5, 124/86, 23.1

[56] References Cited

U.S. PATENT DOCUMENTS 3,840,944 10/1974 Gresley ..... 124/25.7
4,156,496 5/1979 Stinson ..... 124/25.7
4,635,611 1/1987 Priebe ..... 124/25.5
4,995,372 2/1991 Topel ..... 124/25.7 X

*Primary Examiner*—Peter M. Cuomo
*Attorney, Agent, or Firm*—Jack E. Dominik

[57] ABSTRACT

An accessory mount for removable rigid securement of an accessory to a bow is disclosed. In one version, an accessory mount is integrally formed in the outer side face of the bow and provides for the mounting of a bow quiver, a sight for the archer to use in aiming, an overdraw mechanism, or other accessory. More specifically, the mount includes a recess and is defined by a bottom wall of a shallow depth and a pair of horizontal spaced sidewalls and a front wall. The front wall of the recess includes a pair of rectilinear walls extending forwardly and joined at an angle, preferably obtuse, thereby creating a wedge shape having an apex point. The accessory to be mounted includes a corresponding wedge-shaped shoe for fitting into the recess. Threaded fasteners securely engage the shoe in the recess. In alternative versions, male and female interlocking members are provided respectively on the accessory and the archery bow. What is critical is that they be essentially planar in their mating engagement, and have sufficient points to lock the same against rotation in any direction, coupled with screws for removably securing the accessory to the bow.

1 Claim, 3 Drawing Sheets

ACCESSORY MOUNT

This application is a continuation of application Ser. No. 429,842 filed Oct. 31, 1989, now abandoned, and entitled "Accessory Mount", which is a continuation-in-part of application Ser. No. 197,294 filed May 23, 1988, now U.S. Pat. No. 5,005,554, and entitled "Bow Handle Riser", which is a continuation of Ser. No. 920,080 filed Oct. 17, 1986 now abandoned, which in turn is a continuation-in-part of Ser. No. 920,034 filed Oct. 17, 1986 now U.S. Pat. No. 4,697,350 issued Oct. 6, 1987 and a division application of Ser. No. 920,034 filed Oct. 17, 1986, now U.S. Pat. No. 4,697,350 issued Oct. 6, 1987.

FIELD OF THE INVENTION

This invention relates primarily to the archery field, and more specifically, to an accessory recess for mechanism, or combinations thereof, to a bow.

SUMMARY OF THE PRIOR ART

Bows for hunting, whether of the compound or long bow variety, have been known for years. When archers proceed on the hunt, they normally utilize a bow sight, as well as a quiver to store their arrows. More specifically, quivers have been mounted to a bow, but in a rather haphazard manner. Similarly, the bow sight has been mounted to a bow but without coordination with the bow quiver. In both instances, the position is dictated by whatever position on the bow a mount an be made. The resent invention has to do with an accessory recess integrally formed in the bow for receiving a bow accessory such as a sight, bow quiver or overdraw mechanism, or combinations thereof.

SUMMARY OF THE INVENTION

The present invention is directed to an accessory mount for removable rigid securement of an accessory to a bow. In one version, an accessory mount is integrally formed in the outer side face of the bow and provides for the mounting of a bow quiver, a sight for the archer to use in aiming, an overdraw mechanism, or other accessory. More specifically, the mount includes a recess and is defined by a bottom wall of a shallow depth and a pair of horizontal spaced sidewalls and a front wall. The front wall of the recess includes a pair of rectilinear walls extending forwardly and joined at an angle, preferably obtuse, thereby creating a wedge shape having an apex point. The accessory to be mounted includes a corresponding wedge-shaped shoe for fitting into the recess. Threaded fasteners securely engage the shoe in the recess.

In alternative versions, male and female interlocking members are provided respectively on the accessory and the archery bow. What is critical is that they be essentially planar in their mating engagement, and have sufficient points to lock the same against rotation in any direction, coupled with means for removably securing the accessory to the bow.

In view of the foregoing, a principal object of the present invention is to provide a bow accessory mount having a shaped design for receiving a corresponding shoe of an accessory.

Another object of the present invention is to provide multiple bow accessory mounts for mounting multiple accessories such as a sight, bow quiver, or overdraw mechanism.

Yet another object of the present invention is to furnish a buyer with a standard or compound bow with one or more accessory mounts for removably mounting desired accessories.

BRIEF DESCRIPTION OF THE DRAWINGS

Further objects and advantages of the present invention will become apparent as the following description proceeds, taken in conjunction with the accompanying drawings, in which.

DESCRIPTION OF A PREFERRED EMBODIMENT

Figure 1:
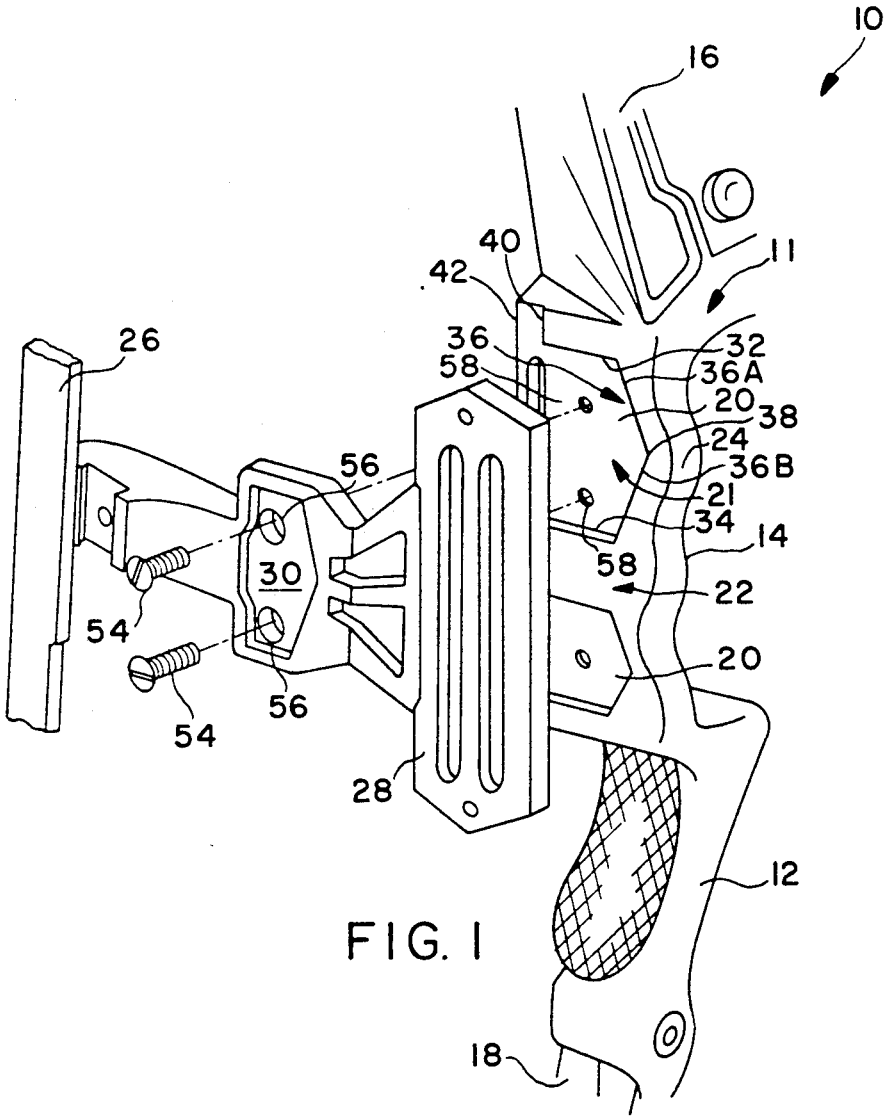
FIG. 1 is an exploded partial perspective view of a bow illustrating the accessory recess of the invention integrally formed in the outer side face of the bow and the manner in which a shoe of a mount of a combined bow quiver and sight accessory is secured into the recess by threaded fasteners.

As shown in FIG. 1, an archery bow 10 typically includes a body 11 having a bow handle portion 12 and a sight window portion 14, with upper and lower limbs 16 and 18 extending therefrom for tensioning a bow string (not shown). In the case of a compound bow, the handle portion 12 and the sight window portion 14 are commonly referred to as a bow riser and the limbs 16 and 18 are removably secured to the terminating ends thereof. Bow accessories such as a sight, bow quiver, or an overdraw mechanism are mounted to a recess 20 of the bow 10, usually to the outer side face 22 of the sight window portion 14.

For purposes of illustrating the present invention, the accessory to be mounted to the recess 20 may comprise a combined bow quiver 26 and sight 28 extending rearwardly and forwardly, respectively, of a mount 30, such as that shown in U.S. Pat. No. 4,697,350 and a patent application Ser. No. 197,294 filed May 23, 1988, now U.S. Pat. No. 5,005,554, the disclosures of which are hereby incorporated by reference herein. It should be understood, however, any bow accessory can be mounted to the recess 20 as desired.

The recess 20 of the invention comprises a bottom wall 21 of a shallow depth and includes opposing parallel horizontal upper and lower spaced sidewalls 32 and 34 and a front wall 36, all extending perpendicularly from the bottom wall 21. Front wall 36 includes a air of rectilinear portions 36A and 36B joined together, preferably obtusely, at apex point 38. The recess 20 extends from a rear face 40 of the sight window portion 14 which may itself be substantially forward of the rearwardmost face 42 of the bow 10.

Figure 2:
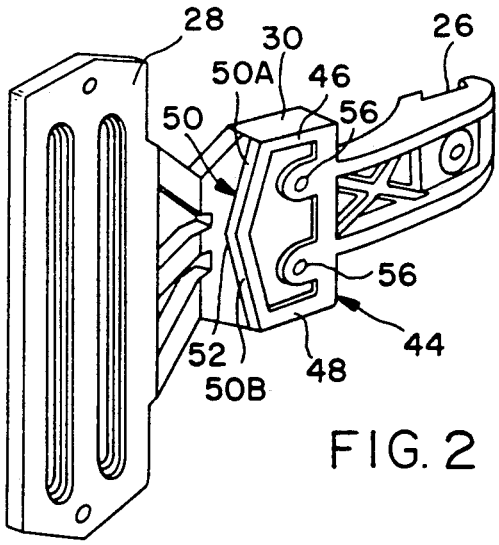
FIG. 2 is a rear view of the combined bow quiver and sight accessory illustrating the shoe which fits into the accessory recess of the invention.
Figure 3:
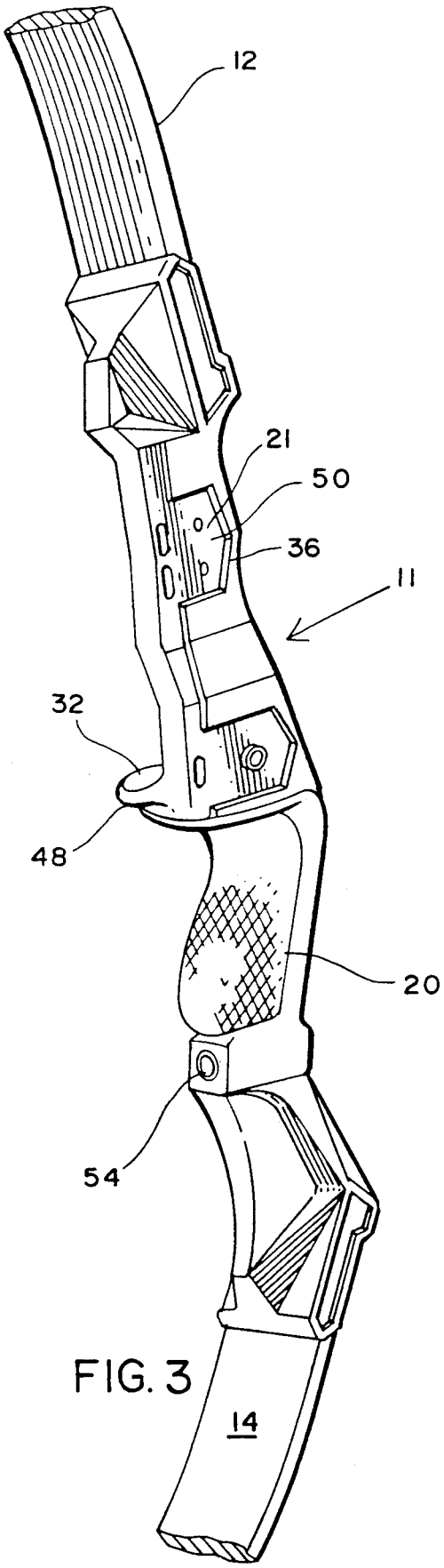
FIG. 3 is a perspective partially broken view of the bow illustrating specifically the recessed embodiment of FIGS. 1 and 2.

As shown in FIG. 2, the mount 30 of the accessory comprises a corresponding shoe 44 having protruding upper and lower sidewalls 46 and 48 and wedge-shaped front wall 50 having rectilinear portions 50A and 50B obtusely joined together at apex point 52.

The shoe 44 is removably but rigidly secured within the recess 20 by means of threaded fasteners 54 which are fitted through holes 56 in the shoe 44 for threaded engagement with threaded holes 58 in the bottom wall 21 of the recess 20.

The shoe 44 is thus configured and dimensioned to slidably fit into recess 20 with minimal play. Indeed, the parallel sidewalls 32 and 34 of the recess 20 and the corresponding sidewalls 46 and 48 of the shoe 44, combined with the wedge-shaped front walls 36 and 50 thereof, minimizes any movement of the shoe 44 within the recess 20.

Finally, it is noted that the bow 10 may include a plurality of recesses 20 for mounting a plurality of accessories. For example, as shown in FIG. 1, an upper recess 20 may be provided for mounting the combined sight and quiver 26 and 28 as described hereinabove and a lower recess 20 for mounting an overdraw mechanism or other accessory (not shown).

Figure 5:
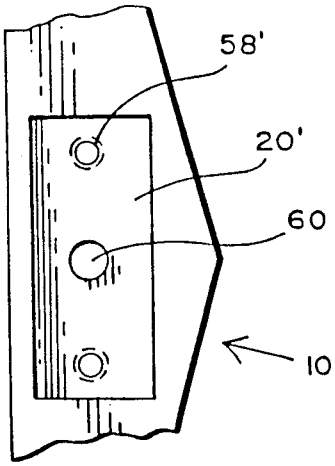
FIG. 5. is an alternative embodiment in which the recess is rectangular having a single locating member.

The alternative first embodiment is shown in FIG. 5 where it will be seen that the recess 20′ is essentially rectangular. The rectangular recess 20′ has one extending protrusion or recess 60 and means for threadedly engaging the accessory mount 58′ the same as in the embodiment already described.

Figure 6:
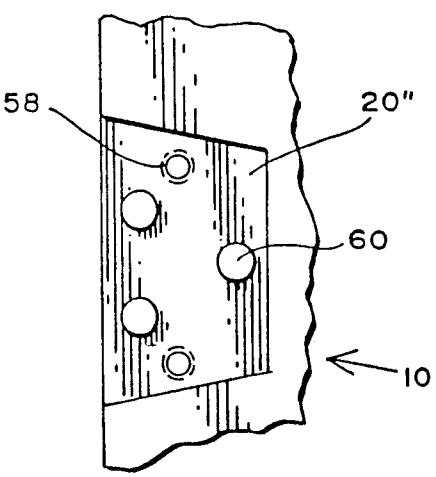
FIG. 6 discloses an isosceles trapezoidal-type configuration with three locating members.
Figure 8:
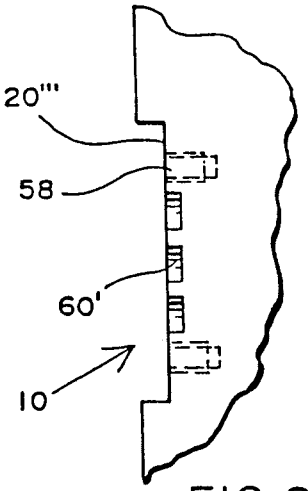
FIG. 8 is the same Figure as FIG. 7 except showing the locking means as female recesses in the bow to receive corresponding extending members from the accessory mount.
Figure 4:
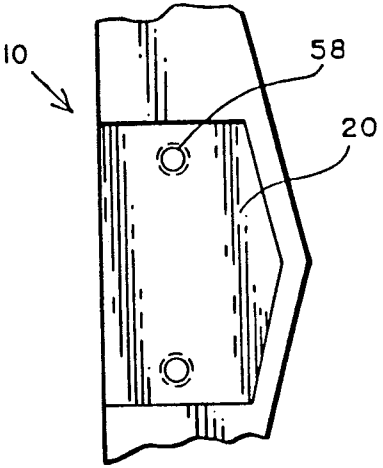
FIG. 4 begins a sequence of alternative embodiments, commencing with the embodiment shown and described in connection with FIGS. 1-3.
Figure 7:
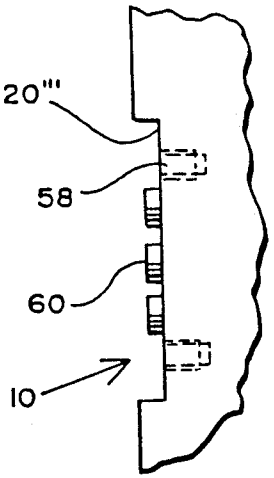
FIG. 7 is a transverse sectional view of the unit shown in FIG. 6 illustrating the locating members as male members projecting from the bow.

In FIG. 6 an alternative is shown in which the recess portion 20″ is essentially isosceles trapezoidal. The protrusions are shown as three cylindrical members on an essentially isosceles triangular orientation. The accessory screw mounts 8 are the same as in the previous embodiments. The isosceles trapezoidal recess 20″ may optionally be flush with the rear portion of the bow as shown in FIG. 4, or may have itself moved forward as shown n FIG. 5. In FIG. 7 the recess 20‴ is shown in which the locking embers 60 extend from the bow and mate with female recesses 60′ in the accessory mount. In FIG. 8, the reverse is shown where the triangularly oriented locking members 60′ are recesses in the bow, to be filled by complimentary extensions 60 on the accessory mount.

Figure 9:
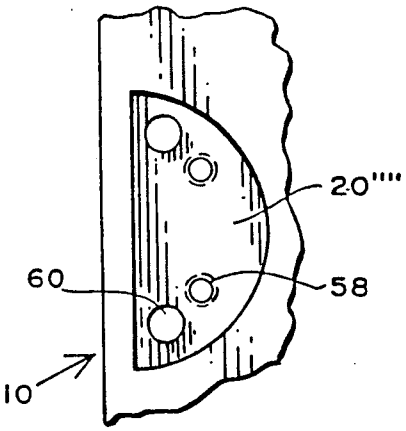
FIG. 9 is yet another embodiment illustrating an accessory mount which is semi-circular, but having locating members and members for removably securing the same.

Finally, FIG. 9 shows that a semi-circular recess 20⁗ can be employed, so long as the locking members 60 are provided (either male or female) and means 58 for removably securing such as screws are also provided.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. An archery bow and bow accessory combination, comprising, a bow body having a handle portion, a sight window portion, and a pair of limbs extending outwardly from said handle portion and said sight window portion for tensioning a bow string;

an accessory for mounting to said bow body;

a recess formed in said bow body, said recess having opposing sidewalls and a front wall all extending from a bottom wall, said front wall including a pair of rectilinear portions joined at an apex point, said recess being formed as an integral part of the handle and extending inwardly into the handle;

a shoe positioned in said bow body accessory mount, said shoe having corresponding protruding side walls and front wall, said front wall including a pair of rectilinear portions joined at an apex point; and means for securing said shoe accessory in said recess.

* * * * *